US007868048B2

(12) United States Patent
Sprague

(10) Patent No.: US 7,868,048 B2
(45) Date of Patent: Jan. 11, 2011

(54) HEAVY OIL EMULSION STABILIZERS CONTAINING SACCHARIDE BASED EMULSION STABILIZER

(75) Inventor: Barry N. Sprague, Bethlehem, CT (US)

(73) Assignee: Technol Fuel Conditioners, Inc., Eatontown, NJ (US)

( * ) Notice: Subject to any disclaimer, the term of this patent is extended or adjusted under 35 U.S.C. 154(b) by 0 days.

(21) Appl. No.: 11/963,952

(22) Filed: Dec. 24, 2007

(65) Prior Publication Data

US 2008/0096983 A1 Apr. 24, 2008

Related U.S. Application Data

(63) Continuation of application No. 10/975,519, filed on Oct. 28, 2004, now abandoned.

(60) Provisional application No. 60/514,885, filed on Oct. 28, 2003.

(51) Int. Cl.

| | |
|---|---|
| ***B01F 3/08*** | (2006.01) |
| ***B01F 17/40*** | (2006.01) |
| *C08L 95/00* | (2006.01) |
| *C10L 8/00* | (2006.01) |

(52) U.S. Cl. ..... 516/29; 516/28; 516/38; 44/301; 44/307

(58) Field of Classification Search ..... 516/38, 516/53, 28, 29; 44/301, 307

See application file for complete search history.

(56) References Cited

U.S. PATENT DOCUMENTS

| | | | | | |
|---|---|---|---|---|---|
| 1,440,356 | A * | 12/1922 | Morrell | ..... | 516/44 |
| 2,077,406 | A * | 4/1937 | Gaertner | ..... | 44/301 |
| 6,187,063 | B1 * | 2/2001 | Gunnerman | ..... | 44/301 |

FOREIGN PATENT DOCUMENTS

| | | | |
|---|---|---|---|
| EP | 0386 550 | A1 * | 9/1990 |
| JP | 58-208388 | * | 12/1983 |
| JP | 63-17960 | * | 1/1988 |

OTHER PUBLICATIONS

JPO on EAST, Patent Abstracts of Japan, Japan patent Office, JP358208388A (Dec. 1983), abstract.*

Derwent Abstract on EAST, week 198403, London: Derwent Publications Ltd., AN 1984-015013, JP 58-208388 A, (Fujimura et al.), abstract.*

Derwent Abstract on EAST, week 199739, London: Derwent Publications Ltd., AN 1988-066487, JP 63017960 A, (Kao Corp), abstract.*

* cited by examiner

*Primary Examiner*—Daniel S Metzmaier
(74) *Attorney, Agent, or Firm*—Thaddius J. Carvis

(57) ABSTRACT

Heavy oil emulsions, comprising decant oils and No. 6, No. 5 and No. 4 oils, and water are stabilized by adding certain saccharide-based esters. Preferably, the saccharide-based esters are naturally-occurring saccharide esters such as gallotannins, saponin, red gum, and the like.

14 Claims, No Drawings

HEAVY OIL EMULSION STABILIZERS CONTAINING SACCHARIDE BASED EMULSION STABILIZER

RELATED APPLICATION

This application is a continuation of U.S. patent application Ser. No. 10/975,519, filed Oct. 28, 2004, now abandon, which is based on and claims priority to provisional U.S. Patent Application Ser. No. 60/514,885, filed Oct. 28, 2003.

BACKGROUND OF THE INVENTION

The invention is directed to heavy fuel oils, and particularly to environmentally benign compositions and methods for making them burn cleanly in the form of emulsions and giving the emulsions long-term stability.

Heavy fuel oils (Numbers 4, 5 and 6) are difficult to burn cleanly. Even with properly maintained equipment of the latest design, substantial amounts of unburned carbon and other products of incomplete combustion are emitted compared to more inherently clean fuels such as gas or distillate oil. Fuels are typically atomized to enhance burning, but the droplets often burn incompletely. The result can be soot production, excessive smoke, carbon monoxide and other problems of poor combustion. One way to improve combustion is to decrease the fuel droplet size entering the flame front, allowing a smaller droplet to burn out completely during the limited time allowed for combustion.

Droplet size can be reduced by improving atomization and by introducing tiny water droplets into the oil in the form of an emulsion. These water droplets are vaporized to steam as the oil droplet starts to burn. The steam produced inside the oil droplet shatters it into many smaller droplets. A typical oil droplet is on the order of 50-100 microns in diameter and it has been found that water droplets in the range of 2-10 microns are very effective and gross water contents of 5-15% wt or so in the fuel provide enough energy to shatter most or almost all the droplets and drastically reduce particulate emissions. $NO_x$ emissions are usually reduced somewhat as well due to the fact that peak flame temperature is reduced slightly leading to a reduction in thermal $NO_x$ formation.

Emulsions have been often discussed in the literature, but there are many shortcomings in the systems useful for their production. The general process is well established and has been is use commercially on a limited scale for many years, but is in need of improvement particularly in terms of providing additional stability and environmentally compatible chemical emulsification and/or stabilization chemicals.

One problem is that chemical stabilizers are needed to keep the water in suspension and prevent the formation of free water on the bottom of the storage tank if the emulsion is meant to be stored before use or transported to a secondary location for combustion. The equipment required to make a No. 6 oil emulsion is rather expensive and these emulsions are frequently made in a single location for distribution to end user sites some distance away.

Emulsion stabilizers in commercial use today are generally surfactants designed to match the hydrophilic-lipophilic balance (HLB) requirements of No. 6 oil to reduce the surface tension at the oil-water interface and form a stable emulsion. These are both (relatively) expensive and are subject to failure when the HLB requirement of the oil changes and, because these droplets have almost no surface tension, they coalesce readily and form a water layer. Thus, when a distillate fuel is mixed with a decant fuel, usually of very different composition and HLB, the result can be similar to deliberately adding a surfactant of known wrong HLB to enhance emulsion separation such as in the case of using a de-emulsifier to break out the small amounts of water that has become emulsified in No. 6 oil during transport and handling to remove it under controlled conditions before distribution. The additive according to the invention is more stable to the variations in formulation that can be expected when using residual fuels.

The HLB requirement changes drastically when the oil characteristics change. The most prevalent comparison is between a "normal" No. 6 oil and a visbroken decant oil. The user of heavy oils often is forced to buy what is available at a low cost and make adjustments to enable efficient burning without undue creation of particulates and other pollution. It would be desirable if such a user would have emulsification additives and systems effective to permit variations in source and type of heavy oil.

Normal No. 6 oil is largely aliphatic and has a density of 1.0 and less and is very viscous. Decant oils have high aromatic contents and have densities above 1.0 and have a lower viscosity. They behave differently during emulsification and have differing stabilizing requirements. Sometimes blends of the two types of oils are commingled in commerce, and/or diluted with distillates to make a No. 5 or No. 4 oil, further complicating the picture. Number 4 and 5 fuel oils are substantially lower in viscosity, making stable emulsions even harder to maintain.

Another practical problem is encountered when a fuel distributor or the like finds water seeping into a heavy oil storage tank and needs to eliminate the tank bottom water. Typically, a distributor might burn such a fuel to maintain temperature in various heavy fuel storage tanks for ease of handling, but cannot easily burn the water contaminated fuel and cannot conveniently dispose of the water because it is contaminated. It would be desirable if there were a way to dispose of the water without pollution, ideally to use it to improve combustion by reducing particulates. The "tank water" below is difficult to emulsify due to the presence of unknown and widely varying contaminants.

The ability to effectively emulsify the water in the tank into the fuel would solve the disposal problem and it would help in reducing particulate emissions; however, this can be accomplished only where the emulsion is stable over a wide range of HLB values due to the variation in such for heavy oils. Also, to assure proper emulsion formation, the tank water must be removed from the tank and sometimes there is a need to supplement the tank water. Thus, the system is highly complex, yet the emulsification must be reproducible and stand up to wide variations in HLB and water mineral contents.

There is a need for a system and additives for emulsification of added and/or tank water to serve two purposes: (1) the elimination of a source of polluted water that must be otherwise disposed of, and (2) the reduction of particulate emissions normally visible when burning normal No. 6 oil.

BRIEF DESCRIPTION OF THE INVENTION

It is an object of the invention to provide emulsification compositions and systems to permit emulsification of heavy oils of widely varying HLB.

It is another object of the invention to provide emulsification compositions and systems to permit emulsification of heavy oils with water from storage tanks.

These and other objectives are accomplished by invention, which is based on the discovery that adding certain saccharide esters, in particular, esters of mono, di and/or oligosaccharides such as glucose, corn syrup or glucose polymers with aromatic acids containing hydroxyl functionalities help stabilize decant oils and No. 6, No. 5 and No. 4 oils, together referred to herein as heavy oils. Unlike surfactants of more typical composition for use as emulsifiers, the stabilizers of the invention are not based on fatty acid esters. They will preferably include esters of functionalities with aromatic groups. For non-decant oils, the addition of a surfactant could be beneficial but not essential, while in the case of decant oils, such an addition is usually detrimental to the stability of the emulsion produced. It has also been found that the addition of conventional nonsaccharide surfactants does not increase the effectiveness of the saccharide-based stabilizers and, in decant oils, can reduce the ability of the stabilizer to stabilize the emulsion.

Other preferred aspects of the invention will be described below.

DETAILED DESCRIPTION OF THE INVENTION

The invention is applicable to heavy fuel oils, and particularly to environmentally benign compositions and methods for making them burn cleanly in the form of emulsions and giving the emulsions long-term stability. Among the heavy oils that can be utilized more effectively because of the invention are heavy fuel oils (Numbers 4, 5 and 6), which are difficult to burn cleanly, as well as decant oils and mixtures. Number 6 oil is largely aliphatic and typically has a density of less than 1.0 and is very viscous. Decant oils have high aromatic contents and have densities above 1.0 and have a lower, yet still high viscosity. They behave differently during emulsification and have differing stabilizing requirements. Sometimes blends of the two types of oils are commingled in commerce, and/or diluted with distillates to be comprised in a No. 5 or No. 4 oil, which have substantially lower viscosities. The preferred compositions of the invention will employ a stabilizer as defined herein, but do not need to contain a surfactant to enjoy maximum applicability of the composition.

The preferred stabilizers are naturally occurring saccharide esters such as gallotannins, tannic acid, red gum, saponin and like saccharide esters. This is surprising in that these are not normally considered surface active agents and interfacial emulsion stabilization is unexpected. Unlike surfactants of more typical composition for use as emulsifiers, the stabilizers of the invention are not based on fatty acid esters. They will preferably include esters of functionalities with aromatic groups. Also preferably, the stabilizers of the invention will be predominantly from natural sources as compared to synthesized surfactants and can be in recovered impure form. HLB values will preferably be consistent with water solubility, e.g., greater than about 10.

Tannic acid is a preferred stabilizer of the invention and is also referred to as gallotannic acid, and can be derived by the extraction of nutgalls with water, desirably with alcohol. Tannic acid, (gallotannic acid) is an astringent vegetable product found in a wide variety of plants. Sources include the bark of oak, hemlock, chestnut, and mangrove; the leaves of certain sumacs; and plant galls. Tannin is also present in tea, coffee, and walnuts. A solution of tannic acid can be obtained from one of these natural sources by extraction with hot water. In particular, gallotannic acid can be obtained from plant gall. It is available commercially as a solid. Tannin varies somewhat in composition, having the approximate empirical formula $C_{76}H_{52}O_{46}$. Tannic acid is a colorless to pale yellow solid. It is believed to be a glucoside in which each of the five hydroxyl groups of the glucose molecule is esterified with a molecule of digallic acid. It is suitable in the form of a poly saccharide esterified with trihydroxybenzoic acid ($C_6(OH)_3$ COOH). In its preferred form, tannic acid is available as a material of commerce and can contain various impurities depending on source and extent of purification. Derivatives of tannic acid, such as tannoform, prepared by condensing 2 moles of tannin with 1 mole of HCHO are also possible stabilizers. Compositions like this and equivalents, are suitable as they are or with suitable solvents or vehicles where insoluble in water but soluble in alcohols.

The gallotannins and their equivalents are materials of commerce of slightly variable composition that are available from many suppliers in commercial forms used for other purposes. The cost of these materials ranges considerably depending on purity and other factors. We have been able to successfully use the less expensive grades of these materials as emulsion stabilizers indicating that the normal commercial concerns requiring high purity materials are not important in securing emulsion stabilization capability. The formulations of the invention are superior to many commercial emulsifiers and stabilizers because they are environmentally friendly because organisms are naturally available in the soil to degrade them.

Saponin and its derivatives will herein be referred to collectively as saponin, which in its preferred form is a polysaccharide esterified with a triterpene. Red gum is useful in any of its commercial forms. It is also known as eucalyptus gum and contains 45% kino-tannic acid, kino-red, glucoside, catechol, pyrocatecheol. It is, therefore, very similar to tannic acid. In a preferred form, red gum is available as an ester of a polysaccharide and hydroxybenzoic acid and other components in amounts which do not inhibit the functionality of the red gum as a stabilizer of the invention. Synthetic products are not fully ruled out, as products such as Glucopon branded additives are effective: polysaccharide/$C_8$-$C_{10}$ ethers. These materials are artificial reaction products with short chain addition groups. Poly acrylic acids and acrylamide may also be present in these materials, but it is unknown how essential the acrylic components are. Exemplary of these is Glucopon 220UP, which is part of a small family of similar compounds by Henkel that are not mixtures with other anionic and nonionic surfactants. Among these are glucopon 225, 225DK, 425, 425N, 425UP, 600, 600UP, 625, 625FE and 625 UP. All are $C_8$-$C_{12}$ maximum ether chain length. The criteria above would eliminate Glucopon AV100, AV120 and LD 45.

Preferred stabilizers of the invention are soluble or dispersible in water and/or polar solvents such as alcohols and the like. Of these, the most preferred solvent is water based both on a cost and a product handling hazard perspective.

These materials can contain sugars, some solutions of these can be prone to fermentation when contaminated with environmental bacteria. This can be prevented with the use of a biological stabilizer such as formaldehyde, glutaraldehyde and other such agents, at effective concentrations, e.g., less than about 0.1%, e.g., about 0.05%. The additive according to the invention will also preferably contain a composition such as an alcohol or glycol in an amount effective to prevent freezing or precipitation of the additive composition. In a preferred form, about 5 to 25% glycol, e.g., about 15% ethylene glycol, is employed.

Emulsions prepared according to the invention have the following advantages, among others:

Improves combustion
Cleans boiler heat transfer surfaces
Reduces emissions and soot blowing
Provides long-term emulsion stability
Is completely miscible in fuel
Reduces atomizing steam
Reduces cold end-deposits and corrosion.

The formulations of the invention, which have been formulated without traditional surfactants, tend to provide the minimum surface tension reduction with good emulsion droplet stability. Higher interfacial tensions aids in preventing excessive shear reduction of droplets prior to combustion during pumping and other handling. Excessively small water droplets (<2 um) tend to have minimal beneficial impact on the combustion process. Excessively large droplets (>10-15 um) are readily reduced during the emulsification process. The additive according to the invention can be added to fuel either by direct injection at the boiler front through specially designed equipment or run through bulk emulsification systems to existing storage tanks. The treatment rate is 1 gallon of additive according to the invention to each 1000 gallons of heavy fuel oil emulsified with from up to about 15% water. Preferably, the stabilizer comprises tannic acid or derivative at a concentration of from about 0.05 to about 0.5% of the weight of the final fuel emulsion.

According to the process of the invention, a heavy oil is emulsified with water containing a stabilizer of the invention. The water can be from any source, including fresh water from lakes and rivers, tap water which has been processed and, very advantageously, tank water found in an oil storage tank. Preferably, the tank water is separated from the oil, admixed with the stabilizer of the invention and then emulsified with the oil. The oil can be one or more of those identified above and can be mixed with yet other materials, including various biologically derived oil stocks and residues.

The following examples are presented to further explain and illustrate the invention by preparing several compositions according to the invention and comparing them to compositions which are not effective for achieving the objectives of the invention. All parts and percentages given below are based on the weight of the indicated materials at the indicated state in process.

Example 1

This example addresses the practical problem of a fuel distributor or the like that finds water seeping into a heavy oil storage tank and what can be done to make an emulsion using tank bottom water. Typically, a distributor might burn fuel to maintain temperature in various heavy fuel storage tanks for ease of handling, but cannot easily burn it due to the presence of water in the tank and cannot conveniently dispose of the water because it is contaminated. To solve this problem, it would be desirable to remove the water and dispose of it. It would also be desirable to improve combustion to reduce particulates.

The ability to effectively emulsify the water in the tank into the fuel would solve the disposal problem and it would help in reducing particulate emissions. However, this can be accomplished only where the emulsion is stable over a wide range of HLB values due to the variation in such for heavy oils. Also, to assure proper emulsion formation, the tank water must be removed from the tank and sometimes it needs to be supplemented with added tap water. Thus, the system is highly complex yet the emulsification must be reproducible and stand up to wide variations in HLB and water mineral contents. The water referred to as "tank water" below is more difficult to emulsify than tap water due to the presence of unspecified contaminants. The emulsification of this water serves two purposes: (1) the elimination of a source of polluted water that must be otherwise disposed of, and (2) the reduction of particulate emissions normally visible when burning normal No. 6 oil. The emulsions formed according to the invention serves both purposes. Others, the more typical situation, are ineffective and not typically employed under the conditions described.

The test data below were generated for lab prepared emulsions using the following test protocol:

1. The Additive Compositions are added to solvent (water or butyl cellosolve) in the amount stated to make a test additive.
2. Test additive is added to water to form additive mix for forming the emulsion.
3. Oil is preheated to 150° F.
4. Water and additive mix is added to hot oil and hand mixed with stirring rod.
5. Crude emulsion is homogenized in hand homogenizer.

The prepared emulsions were tested for stability (ASTM D3707, Modified), as follows:

1. The prepared emulsion is put in a 25×150 mm (50 ml) tube with screw cap and capped.
2. The tube is placed in an oven at 85° C. for 48 hrs. The ASTM has estimated that 48 hours at 85° C. is roughly equivalent to 3 months storage at normal storage conditions.
3. Pass or Fail is determined. Failure is indicated by the formation of large water droplets, a water layer or water pockets on the bottom or sides of the tube.

The following emulsions are prepared using 10% water from the source indicated to emulsify number 6 fuel oil with the Additives identified. As an example, 10% water emulsions treated at 1:1000 with the additive chemical required blending 135 ml hot oil with 15 ml (water+additive blend). The water additive blend in this case consists of 1.0 ml additive in 100 ml water. Corresponding adjustments in these amounts were used for compositions made at the other concentrations listed.

| Additive | Water Source | Additive Feed Rate | Additive Composition | 48 Hr Stability |
|---|---|---|---|---|
| A | Tap | 1/500 | DJR 1000S-1Commercial Fuel Oil Surfactant | Pass |
| A | Tank | 1/500 | DJR 1000S-1Commercial Fuel Oil Surfactant | Fail |
| B | Tank | 1/500 | PEP 99 Commercial Fuel Oil Surfactant | Fail |
| 1 | Tank | 1/500 | 20% red gum in butyl cellosolve | Pass |
| 2 | Tank | 1/500 | 20% solution of tannin | Pass |
| A and 2 | Tank | 1/750 | 50/50 blend | Fail |
| 2 | Tank | 1/1000 | 20% solution of tannin | Pass |
| 3 | Tank | 1/500 | 20% Henkel Glucopon 220UP in butyl cellosolve (alkyl polysaccharide ether/acrylamide) | Pass |
| 4 | Tank | 1/500 | Saponin 20% in water (*Quillaja saponaria* molina) | Pass |

Example 2

This example addresses the practical problem of emulsifying decant oil. A sample of decant (visbroken) No. 6 oil was obtained and shown by experience to be very hard to form stable emulsions due to the low viscosity and very high aromatic content. An emulsion was prepared using Additive A, above, at 1:1000 in 10% water. This emulsion failed in a matter of hours at 60° C. When the same decant oil was emulsified with Additive 2, the emulsion passed for 96 hours under the same conditions.

The above description is intended to enable the person skilled in the art to practice the invention. It is not intended to detail all of the possible modifications and variations, which will become apparent to the skilled worker upon reading the description. It is intended, however, that all such modifications and variations be included within the scope of the invention which is seen in the above description and otherwise defined by the following claims. The claims are meant to cover the indicated elements and steps in any arrangement or sequence which is effective to meet the objectives intended for the invention, unless the context specifically indicates the contrary.

The invention claimed is:

1. An improvement in a method for preparation of heavy oil emulsions, comprising:

adding a saccharide-based ester comprising gallotannin, tannic acid or red gum having an HLB value greater than 10, to water to stabilize emulsions containing droplets of tank water in decant oils and No. 4, 5, or 6 fuel oil.

2. A method according to claim 1 wherein the saccharide-based ester comprises naturally occurring saccharide esters.

3. A method according to claim 1 wherein the ester comprises gallotannin.

4. A method according to claim 1 wherein the ester comprises tannic acid.

5. A method according to claim 1 wherein the ester comprises red gum.

6. A method according to claim 1 wherein the oil is a decant oil and is free of added surfactant.

7. A method according to claim 1 wherein the oil is No. 4, 5, or 6 fuel oil and the emulsion can contain added surfactant.

8. A method according to claim 1 wherein the emulsion comprises up to about 15% water by weight.

9. A method according to claim 1 wherein the emulsion comprises from 5 to 10% water by weight.

10. A method according to claim 1 wherein the stabilizer comprises tannic acid at a concentration of from about 0.05 to about 0.5% of the weight of the composition.

11. A composition according to claim 1.

12. A method according to claim 1, which includes the further step of removing water from a heavy oil storage tank and adding that water to the decant oils or No. 4, 5, or 6 fuel oil for emulsification with the decant oils or No. 4, 5, or 6 fuel oil, and stabilizer.

13. A method according to claim 1, which includes the further step of mixing the water and decant oils or No. 4, 5, or 6 fuel oil under shear conditions sufficient to emulsify the water into the oil.

14. A method for preparation of heavy oil emulsions, comprising:

adding an additive comprising tannic acid or a derivative having an HLB value greater than 10 and from 5 to 25% by weight of a glycol, based on said additive; to a decant oils or No. 4, 5, or 6 fuel oil containing water in an amount up to 15%; by weight and emulsifying the water in the oil to form a stable emulsion containing droplets of water in the oil.

* * * * *